US005787609A

United States Patent [19]

Wu

[11] Patent Number: 5,787,609

[45] Date of Patent: Aug. 4, 1998

[54] SHOCK-ABSORBING DEVICE FOR SHOE OR SHOE PAD

[76] Inventor: Andy Wu, No. 10, Lane 139, Sec. 1, Chain-Pin Rd., Taichung, Taiwan

[21] Appl. No.: 743,622

[22] Filed: Nov. 4, 1996

[30] Foreign Application Priority Data

Oct. 4, 1996 [CN] China ..... 96219170.1

[51] Int. Cl.[6] ..... A43B 13/20; A43B 21/26; A43B 21/32

[52] U.S. Cl. ..... 36/28; 36/29; 36/35 R; 36/35 B; 36/71

[58] Field of Search ..... 36/28, 29–31, 36/30 R, 35 R, 37, 35 B, 43, 71, 141, 153

[56] References Cited

U.S. PATENT DOCUMENTS 4,183,156 1/1980 Rudy .
4,219,945 9/1980 Rudy .
4,340,626 7/1982 Rudy .

*Primary Examiner*—Paul T. Sewell
*Assistant Examiner*—Anthony Stashick
*Attorney, Agent, or Firm*—Browdy and Neimark

[57] ABSTRACT

A footwear shock-absorbing device comprises a main body, at least one shock-absorbing body having a plurality of cavities, and a pliable base equal in number to the shock-absorbing body for sealing off the bottom openings of the cavities such that the pliable base and the cavities form jointly a plurality of the closed air cells capable of alleviating the shock.

17 Claims, 2 Drawing Sheets

SHOCK-ABSORBING DEVICE FOR SHOE OR SHOE PAD

FIELD OF THE INVENTION

The present invention relates generally to a footwear, and more particularly to a shock-absorbing device intended for use in the footwear or the shoe pad.

BACKGROUND OF THE INVENTION

The U.S. Pat. Nos. 4,183,156, 4,219,945 and 4,340,626 disclose respectively a shoe shock-absorbing device, which comprises an air sac of a plastic material and is arranged in the midsole of a footwear to alleviate the impact. The production of the plastic sac requires the use of the special production facilities, whereas the filling of the plastic sac with a specific kind of gas also calls for the use of the special equipment. As a result, the production cost of the shoe shock-absorbing devices of the prior art is rather high. Moreover, the plastic sac is vulnerable to leak.

SUMMARY OF THE INVENTION

The primary objective of the present invention is to provide an improved shoe shock-absorbing device, which is made of a material capable of absorbing shock and is composed of a plurality of air cells capable of lessening the impact.

In keeping with the principle of the present invention, the foregoing objective of the present invention is attained by a shoe shock-absorbing device, which comprises a main body having a shape of the shoe, at least one shock-absorbing body having a plurality of cavities, and a pliable base equal in number to the number of shock-absorbing bodies used per shoe for sealing off the bottom openings of the cavities such that the liable base and the cavities form jointly a plurality of the closed air cells capable of alleviating the shock.

The foregoing objective, features, functions and advantages of the present invention will be more readily understood upon a thoughtful deliberation of the following detailed description of the embodiments of the present invention in conjunction with the accompanying drawings.

DETAILED DESCRIPTION OF THE INVENTION

Figure 1:
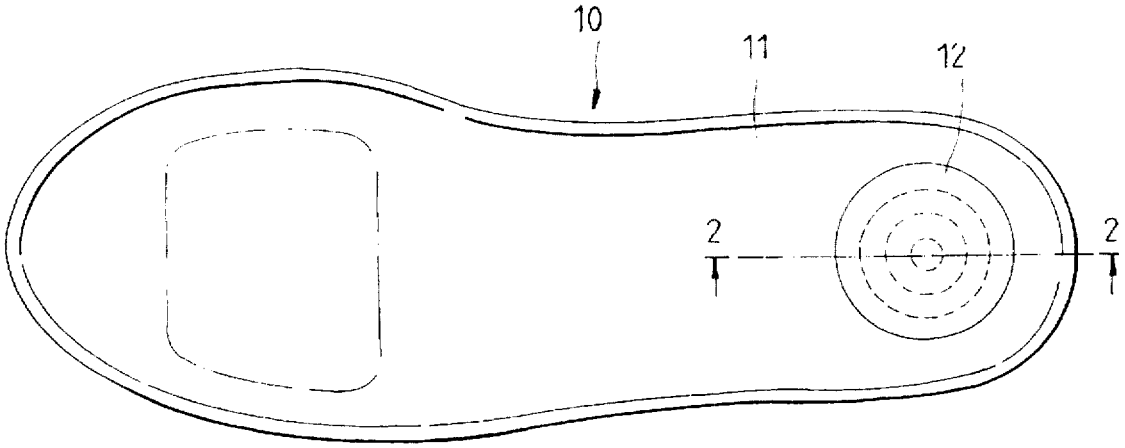
FIG. 1 is a top view of a first preferred embodiment of the present invention to illustrate the incorporation of the present invention with a shoe pad.
Figure 2:
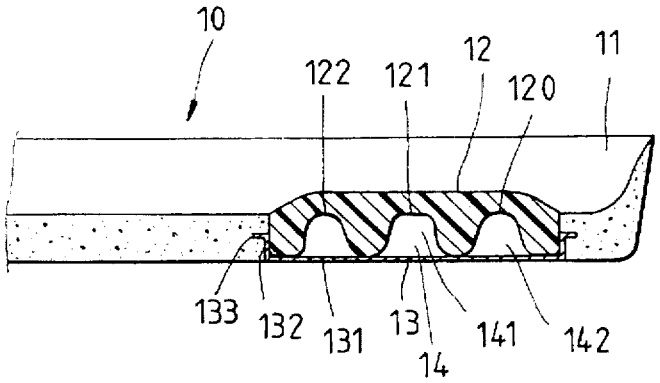
FIG. 2 shows an enlarged sectional view taken along a line 2—2 as shown in FIG. 1.

As shown in FIGS. 1 and 2, a shock-absorbing device 10 of a shoe pad embodied in the present invention is composed of a shoe pad main body 11, a shock-absorbing body 12, and a pliable base 13.

The shoe pad main body 11 is similar in shape to a shoe insole and is located on the shoe insole.

The shock-absorbing body 12 is less resilient than the shoe pad main body 11 and is more capable of absorbing the shock than the shoe pad main body 11. The shock-absorbing body 12 is located in the main body 11 such that the shock-absorbing body 12 is corresponding in location to a foot heel. The shock-absorbing body 12 is provided with a plurality of cavities 120 having an opening which faces the shoe insole. The shock-absorbing body 12 is provided at the center thereof with an independent round cavity 121, and a circular cavity 122 encircling the round cavity 121.

The pliable base 13 is made of a rubber or plastic material, or a blended material of rubber and plastic. The pliable base 13 is fastened with the underside of the shock-absorbing body 12 such that the openings of the cavities of the shock-absorbing body 12 are sealed off by the pliable base 13, and that a plurality of the closed air cells 14 are formed of the cavities.

A round air cell 141 is formed of the round cavity 121, whereas a circular air cell 142 is formed of the circular cavity 122. The air cells 14 embodied in the present invention may be located independently or continuously. In addition, the air cells 14 may have any appropriate shape.

In the process of making the present invention, the shock-absorbing body 12 and the pliable base 13 are joined together by means of an adhesive or a mechanical joint before they are arranged in an injection molding machine, in which the shoe pad main body 11 of a foam PU is formed integrally by injection molding.

The pliable base 13 may have any appropriate thickness as long as it can seal off the cavities 120 effectively. The shock-absorbing body 12 of the present invention is round in shape. The pliable base 13 has a round body 131 having a flat portion 132 extending upwards from the fringe thereof such that the flat projection 132 is perpendicular to the fringe. The flat portion 132 is provided with a shoulder 133 extending outwards. The flat portion 132 and the round body 131 form a round cover engageable with the shock-absorbing body 12. The shoulder 133 is intended to reinforce the fastening strength of the shoe pad main body 11.

According to the first preferred embodiment of the present invention, the shock-absorbing body 12 is joined with the shoe pad main body 11 such that the top end of the shock-absorbing body 12 projects above the shoe pad main body 11. The top surface of the shock-absorbing body 12 may be flat, knobbed, or striped.

The shock-absorbing body 12 of the present invention is capable of absorbing a portion of impact energy when the top surface of the shock-absorbing body 12 is exerted on by the treading force of the foot heel. In the meantime, the air contained in the air cells 14 serves as cushion to alleviate the impact force of the foot heel. It must be noted here that the shock-absorbing device 10 of the present invention may be located in any part of the shoe pad main body 11. For example, the sole of the shoe pad main body 11 may be provided therein with one or more shock-absorbing devices 10 of the present invention. In addition, the underside of the shock-absorbing body 12 and the upper side of the pliable base 13 may not be necessarily attached in view of the fact that they will be forced to become intimately attached when the shock-absorbing body 12 is under pressure. As a result, the air contained in the air cells serves as cushion to mitigate the impact. As the deformed shock-absorbing body 12 is relieved of the pressure of the foot treading thereon, the deformed shock-absorbing body 12 is capable of regaining its original shape. The shock-absorbing device 10 of the present invention is devoid of the air sac of the prior art and is therefore cost-effective and low in rejection rate.

Figure 3:
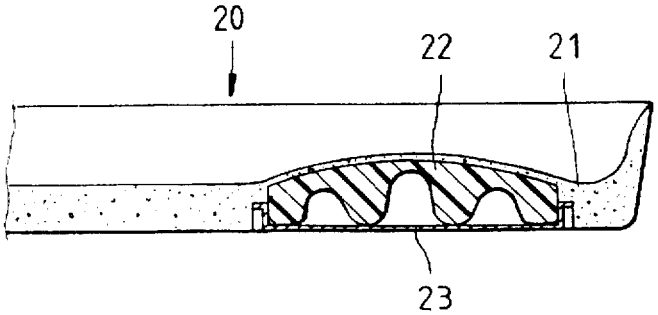
FIG. 3 shows a sectional view of a second preferred embodiment of the present invention, with the sectional view being taken along the direction similar to the line 2—2 as shown in FIG. 1.
Figure 4:
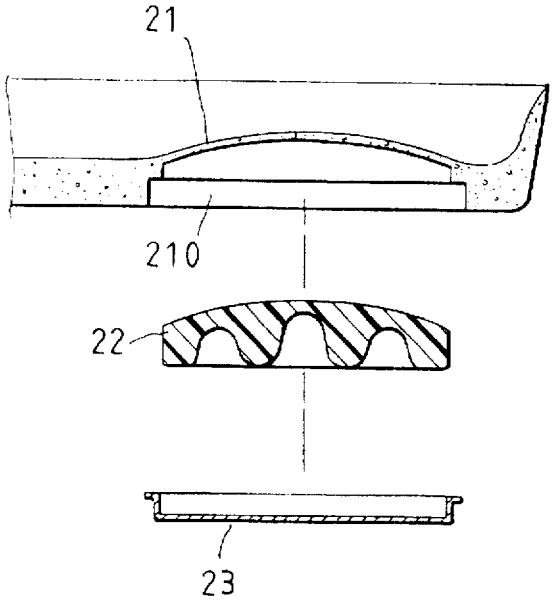
FIG. 4 shows an exploded view of the shoe pad of the second preferred embodiment of the present invention.

As shown in FIGS. 3 and 4, a shoe pad 20 of the second preferred embodiment of the present invention is composed of a main body 21, which is located in the heel or the sole and is provided with a slot 210. A shock-absorbing body 22 and a base 23 are joined together by an adhesive before they are disposed in the slot 210. The top of the shock-absorbing body 22 is not exposed as it is covered by a portion of main body 21.

Figure 5:
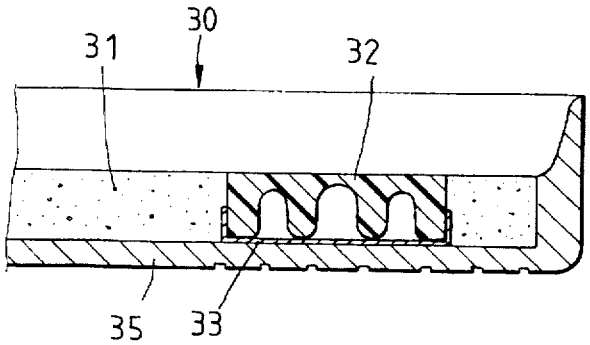
FIG. 5 shows a sectional view of a shoe sole of a third preferred embodiment f the present invention.

As shown in FIG. 5, a shoe sole 30 of the third preferred embodiment of the present invention has a main body 31, which is provided at a predetermined position thereof with a through hole for receiving therein a shock-absorbing body 32 and a base 33 which are adhered together. The shock-absorbing body 32, the base 33, and the main body 31 may be made integrally by injection molding. The sole 30 is provided with a large base 35 which is attached thereunder or formed integrally thereunder by injection molding.

Figure 6:
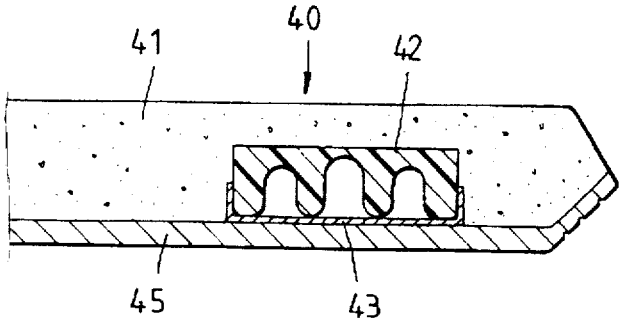
FIG. 6 shows a sectional view of a shoe sole of a fourth preferred embodiment of the present invention.

Another sole 40 of the fourth preferred embodiment of the present invention is illustrated in FIG. 6 and is composed of a main body 41 which is provided in the underside thereof with a recess for receiving a shock-absorbing body 42 and a base 43 which is attached to the shock-absorbing body 42. The sole 40 is provided with a large base 45 attached thereunder.

What is claimed is:

1. A shock-absorbing device for a footwear, said device comprising:

a main body similar in shape to a footwear insole;

at least one shock-absorbing body located in a predetermined portion of said main body and having a plurality of cavities in an underside of said shock-absorbing body; and each said shock-absorbing body covered by a pliable base disposed under said shock-absorbing body such that openings of said cavities of said shock-absorbing body are covered and not sealed by said pliable base, wherein a plurality of closed air cells are formed by said cavities only when said pliable base is pressed against a surface by a user.

2. The device as defined in claim 1, wherein said main body is a footwear sole of a shoe.

3. The device as defined in claim 1, wherein said main body is a shoe pad located on an insole of said footwear.

4. The device as defined in claim 1, wherein said shock-absorbing body is located in said main body such that a top of said shock-absorbing body projects over an upper surface of said main body.

5. The device as defined in claim 1, wherein said shock-absorbing body is located in said main body such that a top of said shock-absorbing body is located under an upper surface of said main body.

6. The device as defined in claim 1, wherein said cavities of said shock-absorbing body are independent of one another.

7. The device as defined in claim 6, wherein said shock-absorbing body is provided with an independent cavity around an axis perpendicular to a plane of the pliable base and through a center of said shock absorbing body.

8. The device as defined in claim 1, wherein said shock-absorbing body and said pliable base are located in said main body such that said shock-absorbing body and said pliable base correspond in location to a human foot heel.

9. The device as defined in claim 1, wherein said shock-absorbing body and said pliable base are located in said main body such that said shock-absorbing body and said pliable base correspond in location to a human foot sole.

10. A shock-absorbing device for a footwear, said device comprising:

a main body similar in shape to a footwear insole;

at least one shock-absorbing body located in a predetermined portion of said main body and having a plurality of cavities in an underside of said shock-absorbing body; and each said shock-absorbing body covered by a pliable base disposed below said shock-absorbing body such that openings of said cavities of said shock-absorbing body are covered and not sealed by said pliable base, wherein a plurality of closed air cells are formed by said cavities only when said pliable base is pressed against a surface by a user, wherein said shock-absorbing body is provided with an independent cavity around an axis perpendicular to a plane of the pliable base and through a center of said shock absorbing body.

11. The device as defined in claim 10, wherein said main body is a footwear sole of a shoe.

12. The device as defined in claim 10, wherein said main body is a shoe pad located on a insole of said footwear.

13. The device as defined in claim 10, wherein said shock-absorbing body is located in said main body such that a top of said shock-absorbing body projects over an upper surface of said main body.

14. The device as defined in claim 10, wherein said shock-absorbing body is located in said main body such that a top of said shock-absorbing body is located under an upper surface of said main body.

15. The device as defined in claim 10, wherein said cavities of said shock-absorbing body are independent of one another.

16. The device as defined in claim 10, wherein said shock-absorbing body and said pliable base are located in said main body such that said shock-absorbing body and said pliable base correspond in location to a human foot heel.

17. The device as defined in claim 10, wherein said shock-absorbing body and said pliable base are located in said main body such that said shock-absorbing body and said pliable base correspond in location to a human foot sole.

* * * * *